US008047523B2

(12) United States Patent
Terao et al.

(10) Patent No.: US 8,047,523 B2
(45) Date of Patent: Nov. 1, 2011

(54) SHEET LOADING APPARATUS, SHEET POST-PROCESSING APPARATUS AND IMAGE FORMING APPARATUS

(75) Inventors: Yasunobu Terao, Shizuoka-ken (JP); Katsuya Sasahara, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 215 days.

(21) Appl. No.: 12/563,619

(22) Filed: Sep. 21, 2009

(65) Prior Publication Data

US 2010/0117287 A1 May 13, 2010

Related U.S. Application Data

(60) Provisional application No. 61/112,627, filed on Nov. 7, 2008, provisional application No. 61/178,410, filed on May 14, 2009.

(30) Foreign Application Priority Data

Jul. 21, 2009 (JP) ..... 2009-169985

(51) Int. Cl.
*B65H 37/04* (2006.01)

(52) U.S. Cl. ..... 270/58.11; 270/58.14; 270/58.18; 270/58.08

(58) Field of Classification Search ..... 270/58.01, 270/58.07, 58.08, 58.11, 58.14, 58.18
See application file for complete search history.

(56) References Cited

U.S. PATENT DOCUMENTS

| | | | | |
|---|---|---|---|---|
| 5,072,920 | A * | 12/1991 | Kubota et al. | 270/58.11 |
| 5,709,376 | A * | 1/1998 | Ushirogata | 270/58.11 |
| 7,354,035 | B2 | 4/2008 | Terao et al. | |
| 7,413,176 | B2 * | 8/2008 | Hirata et al. | 270/58.08 |
| 7,497,425 | B2 * | 3/2009 | Taguchi et al. | 270/37 |
| 7,530,566 | B2 | 5/2009 | Terao et al. | |
| 2002/0053766 | A1 * | 5/2002 | Kubota | 270/58.08 |
| 2004/0084828 | A1 * | 5/2004 | Sato et al. | 270/58.08 |
| 2006/0067768 | A1 | 3/2006 | Terao et al. | |
| 2006/0076725 | A1 * | 4/2006 | Matalevich et al. | 270/58.08 |

FOREIGN PATENT DOCUMENTS

| | | |
|---|---|---|
| JP | 4044557 | 2/2008 |
| JP | 2008-094612 A | 4/2008 |

* cited by examiner

*Primary Examiner* — Patrick Mackey
(74) *Attorney, Agent, or Firm* — Patterson & Sheridan, LLP

(57) ABSTRACT

A sheet loading apparatus has an ejecting member to eject a sheet; a loading member to load the sheet ejected by the ejecting member; and a movable member capable of moving in a state keeping contact with ejecting member side ends of the sheets loaded on the loading member. The movable member moves a distance equal to a moving distance of the loading member in the moving direction of the loading member. The sheet loading apparatus has a screen which is located between the loading member and the ejecting member and moves up and down, while waits at a position capable of avoiding interruption to the ejection of the sheet; and a first rotating member mounted to the screen in a location above the loading member and suspending the movable member.

20 Claims, 14 Drawing Sheets

SHEET LOADING APPARATUS, SHEET POST-PROCESSING APPARATUS AND IMAGE FORMING APPARATUS

CROSS-REFERENCE TO RELATED APPLICATION

This application is based upon and claims the benefit of priority from the prior U.S. Patent Application No. 61/112,627, filed on Nov. 7, 2008, U.S. Patent Application No. 61/178,410, filed on May 14, 2009 and Japanese Patent Application, No. 2009-169985, filed on Jul. 21, 2009; the entire contents of all of which are incorporated herein by reference.

FIELD OF THE INVENTION

The present invention relates to a sheet loading apparatus for loading sheets, a sheet post-processing apparatus, and an image forming apparatus.

DESCRIPTION OF THE BACKGROUND

An apparatus described in the Japanese Patent Application Publication No. 2005-75572 ejects sheets conveyed from an image forming apparatus onto a stacking tray. The stacking tray is mounted to a apparatus main body so as that the downstream side of the stacking tray in the sheet conveying direction is located higher than the upstream side of the stacking tray. Thereby, the sheet ejected on the stacking tray slides down on the slope of the stacking tray, and then the posterior end of the sheet hits a wall (or a grating) of the apparatus main body. The apparatus main body has a sensor for detecting the top of the stacked sheets on the stacking tray. The stacking tray moves up and down along the apparatus main body to a position where the sheets stacked on the stacking tray avoids blocking a sheet ejecting vent of the apparatus main body, based on a detection signal detected by the sensor.

However, in the above-mentioned device, when the stacking tray moves up and down in a state that the posterior end of sheets keeps contact with the wall surface of the apparatus main body, a noise occurs due to vibration of the posterior end of the sheets according to friction of the posterior ends of the sheets and the wall surface of the apparatus main body. In particular, in an overload state of the sheets or in a state that the sheets are thick, there is a problem that the noise according to vibration becomes large and yields troublesome for a user.

As a device having solved the above-mentioned problem, there is a sheet loading apparatus as disclosed in Japanese Patent Application Publication No. 2008-94612. This sheet loading apparatus is provided with a sheet receiving tray elevating in loading a bundle of sheets ejected from a sheet post-processing apparatus, a first driving source and an end-fence for aligning the posterior ends of the bundle of sheets. This end-fence is characterized by elevating in accompany with the elevation of a sheet receiving tray. Thereby, a disorder of the stack state caused by the posterior ends of the sheets rubbing against the end-fence, dirt or dent of the sheets, a noise caused by rubbing of the sheets against the end-fence.

In the above-mentioned sheet loading apparatus having a waiting tray and a processing tray, when there is no problem. However, there is a problem that, when sheets are ejected directly from the waiting tray to the sheet receiving tray, sheets unexpectedly enters into the opening portion of a processing tray.

SUMMARY OF THE INVENTION

An object of the present invention is to provide a sheet loading apparatus, a sheet post-processing apparatus, and an image forming apparatus in which noise due to sheets loaded on tray is suppressed, and the sheets are certainly ejected and loaded on the sheet receiving tray.

To achieve the above advantage, the aspect of the present invention is to provide a sheet loading apparatus comprising: an ejecting member to eject a sheet; a loading member to load the sheet ejected by the ejecting member; a movable member capable of moving in a state keeping contact with ejecting member side ends of the sheets loaded on the loading member, the movable member moving a distance equal to a moving distance of the loading member in the moving direction of the loading member; a screen which is located between the loading member and the ejecting member and moves up and down, while waits at a position capable of avoiding interruption to the ejection of the sheet; and a first rotating member mounted to the screen in a location above the loading member and suspending the movable member.

Further, to achieve the above advantage, another aspect of the present invention is to provide sheet post-processing apparatus comprising: a waiting tray to queue sheets for a sheet post-processing; a processing tray which is located underneath the waiting tray and receives the sheets supplied from the waiting tray; a stapler to staple the ends of a plurality of sheets supplied on the processing tray; a loading member to load sheets; an ejecting member to eject the sheets from at least one of the waiting tray and the processing tray to the loading member; a movable member capable of moving in a state keeping contact with ejecting member side ends of the sheets loaded on the loading member, the movable member moving a distance equal to a moving distance of the loading member in the moving direction of the loading member; a screen which is located between the loading member and the ejecting member and moves up and down, while waits at a position capable of avoiding interruption to the ejection of the sheet; and a first rotating member mounted to the screen in a location above the loading member and suspending the movable member.

Further, to achieve the above advantage, still another aspect of the present invention is to provide an image forming apparatus comprising: an image forming portion to form images on sheets; and a sheet loading apparatus to load the sheets formed thereon the images and taken out from the image forming portion, wherein the sheet loading apparatus including: an ejecting member to eject a sheet from the image forming portion; a loading member to load the sheet ejected by the ejecting member; a movable member capable of moving in a state keeping contact with ejecting member side ends of the sheets loaded on the loading member, the movable member moving a distance equal to a moving distance of the loading member in the moving direction of the loading member; a screen which is located between the loading member and the ejecting member and moves up and down, while waits at a position capable of avoiding interruption to the ejection of the sheet; and a first rotating member mounted to the screen in a location above the loading member and suspending the movable member.

DETAILED DESCRIPTION OF THE INVENTION

First Embodiment

Now, a first embodiment of the present invention will be described in reference to the drawings.

Figure 1:
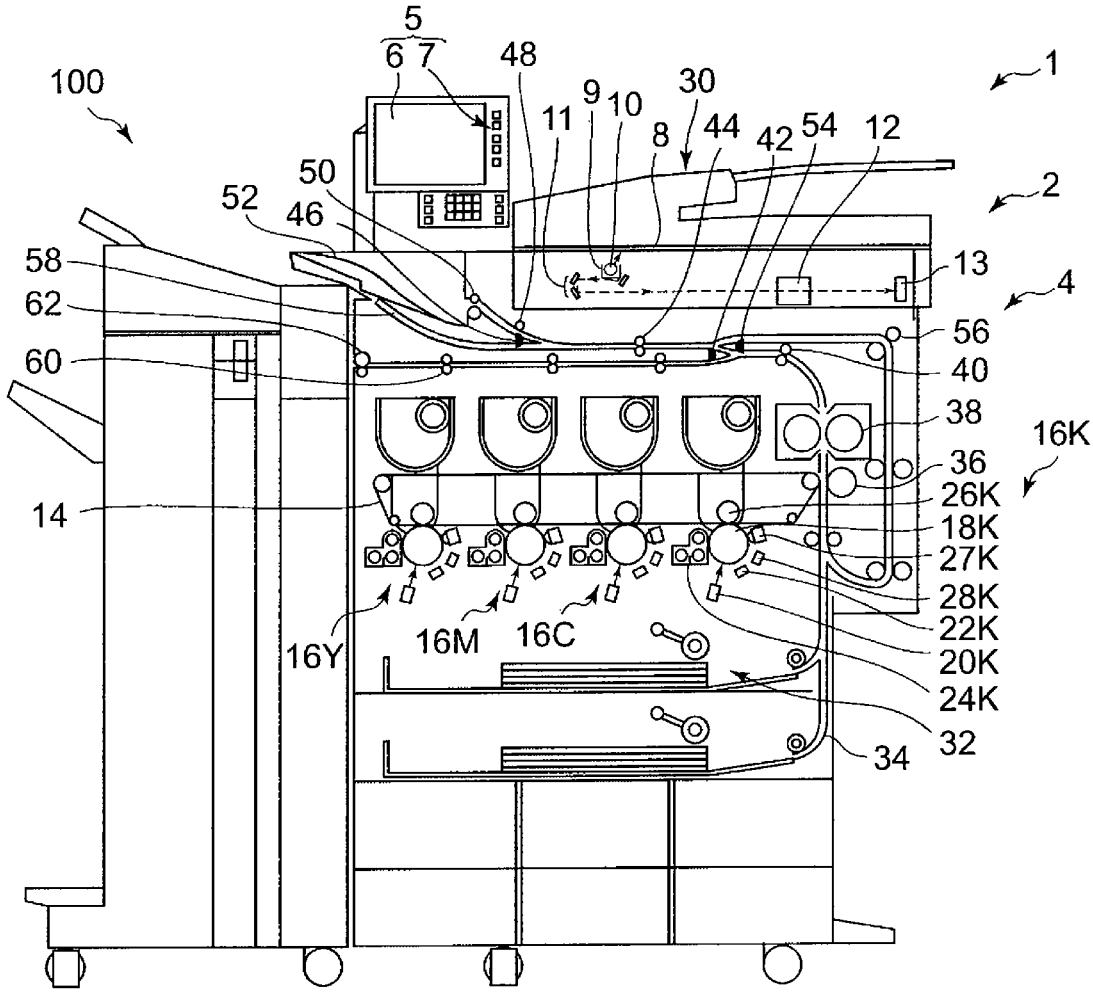
FIG. 1 is a schematic block diagram showing an image forming apparatus.

FIG. 1 is a schematic diagram showing an image forming apparatus 1.

The image forming apparatus 1 is provided with an image reader 2 for reading an image subjected to be read, and an image-forming portion 4 for forming an image. The image forming apparatus 1 is further provided with a display portion 6 with a touch panel and an operation panel 5 equipped with various kinds of operation keys 7.

The operation keys 7 on the operation panel 5 is, for example, provided with a numeric keypad, a reset key, a stop key, a start key, etc. In the display portion 6, for example, a variety of instructions, for example, such as a sheet size, a number of copies, a printing density, with or without binding, with or without clinching, etc., are input.

The image reader 2 is provided with a document table 8, a carriage 9, an exposure lamp 10, a reflector mirror 11, an imaging lens 12, and a CCD (charge-coupled device) 13. The CCD 13 is a photoelectric conversion element which takes in a reflected light and converts the reflected light to an electric signal. Above the document table 8, an automatic document feeder 30 for conveying a document to a reading position is formed.

The image forming portion 4 is provided with an intermediate transfer belt 14 as a transfer medium, and four processing units 16Y, 16M, 16C and 16K corresponding to color toners of yellow (Y), magenta (M), cyan (C) and black (K) which are arranged in a line along the intermediate transfer belt 14.

The processing unit 16K is provided with a photosensitive drum 18K as an image carrier, a laser unit 20K for forming an electrostatic latent image on the photosensitive drum 18K, a main charger 22*k* and a developing device 24K which are placed in series around the photosensitive drum 18K, a primary transfer device 26*k* facing the photosensitive drum 18K through an intermediate transfer belt 14, a cleaner 27*k* and a charge elimination lamp 28*k*. The processing units 16Y, 16M and 16C have a construction the same as the processing unit 16K. Now, an image-forming processing will be explained in reference to the processing unit 16K of black (K).

To begin with, a document is laid on an image reading position of the document table 8. Otherwise, an automatic document feeder 30 feeds the document on the image reading position. Subsequently, the exposure lamp 10 which the carriage 9 supports applies light from the lower part of the document table 8 to a document. The reflector mirror 11 guides the light reflected from a document to the imaging lens 12. The imaging lens 12 converges the image of the light reflected from the document, and projects it to a CCD 13. The CCD 13 takes in the reflected light and outputs the image information of the document with an analog signal. The electric signal output from the CCD 13 is converted into a digital signal. The laser unit 20K receives the digital signal executed an image processing.

When the image-forming processing starts in the image-forming portion 4, the main charger 22K will charge the peripheral surface of the rotating photosensitive drum 18K. In order to form an electrostatic latent image on the peripheral surface of the rotating photosensitive drum 18K which is charged to a potential uniform in the axial direction according to the main charger 22K, the laser unit 20K irradiates a laser beam according to the digital signal executed the image processing. The developing device 24K supplies developing powder (e.g., toner) of black on the peripheral surface of the photosensitive drum 18K, and alters the electrostatic latent image to a toner image of black (K). The primary transfer device 26K electro-statically transcribes the toner image of black (K) onto the intermediate transfer belt 14.

The cleaner 27K laying downstream the primary transfer device 26K in the rotational direction of the photosensitive drum 18K removes the toner remained by not transferred on the photosensitive drum 18K. The charge elimination lamp 28K removes the residual charge on the peripheral surface of the photosensitive drum 18K in the downstream side in the rotational direction of the photosensitive drum 18K than the cleaner 27K. In color image formation, the processing units 16Y, 16M and 16C execute the above-described operation in a similar way.

The toner image transferred by the intermediate transfer belt 14 is electro-statically transferred by the secondary transfer device 36 to the sheet conveyed from the sheet supply device 32 through the conveying path 34. The fixing device 38 fixes the toner image on the sheet. The conveying roller 40 conveys the sheet with the fixed toner image to in which it was fixed to the toner image to the branching member 42.

The branching member 42 guides the sheet to the reversing roller 44 or the conveying roller 60 based on the processing of the sheet. When the branching member 42 guides the sheet to the reversing roller 44, the reversing roller 44, the branching member 46 and the conveying roller 48 conveys the sheet to the sheet ejecting roller 50, and the sheet ejecting roller 50 ejects the sheet to the upper sheet-receiving tray 52.

In a case of executing double-sided printing, the branching member 42 guides the sheet to the reversing roller 44, the reversing roller 44 rotates in the reverse direction, and the branching member 42 conveys the sheets to the branching member 54. The branching member 54 guides the sheets to the conveying roller 56, and the conveying roller 56 conveys the sheets to the secondary transfer device 36. As a result, the secondary transfer device 36 transcribes a toner image to the opposite surface of the conveyed sheets. The fixing device 38 fixes the toner image on the sheet. When the size of the sheet is large (for example, A3 size sheet), the branching member 46 guides A3 size sheet to a reversal sheet path, the reversing roller 44 reverse-rotates, and A3 size sheet is conveyed to the branching member 54.

When the branching member 42 guides the sheet to the conveying roller 60, the conveying roller 60 conveys the sheet to the taking-out roller 62, and the taking-out roller 62 ejects the sheet to the sheet post-processing apparatus 100. The sheet referred herein means, for example, a plain paper sheet, a heavy sheet, a thin sheet, a coated sheet, or an OHP sheet.

Figure 2:
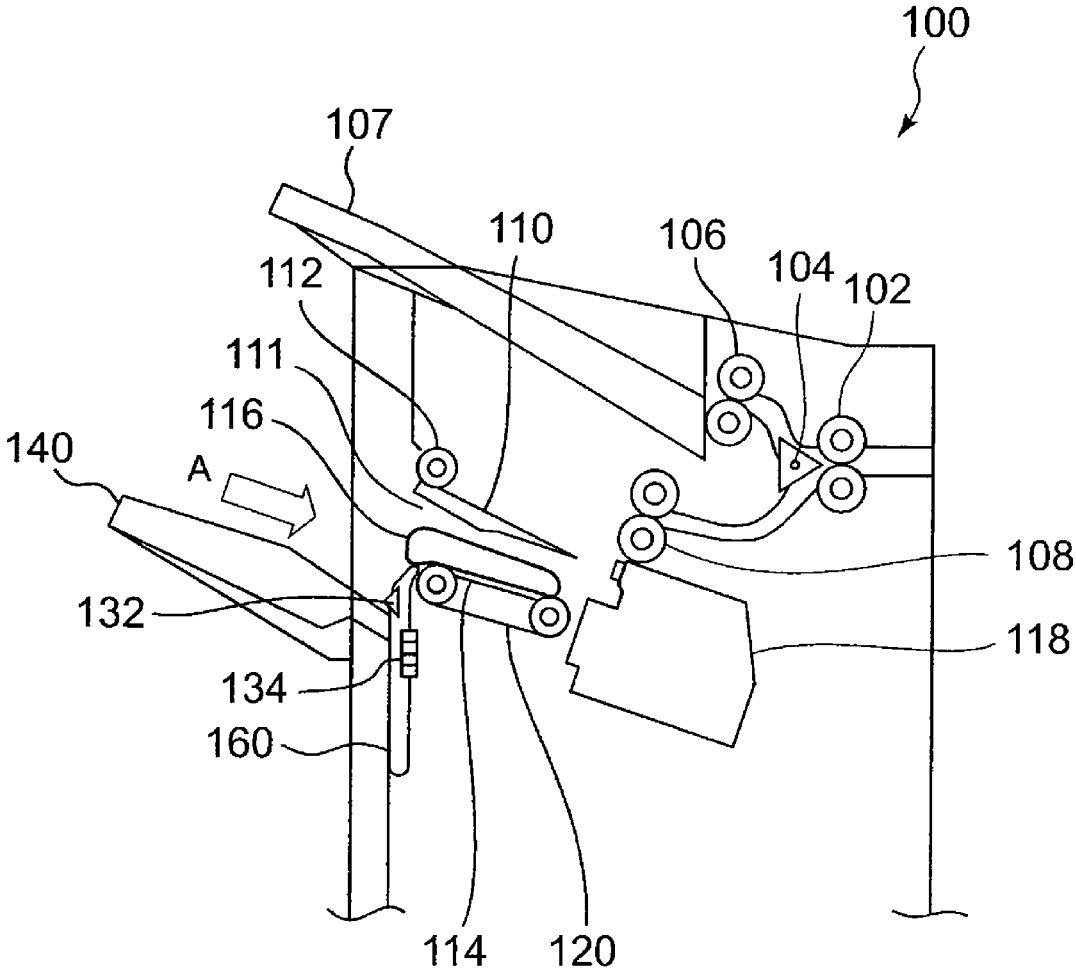
FIG. 2 is a schematic diagram showing a sheet post-processing apparatus.

FIG. 2 is a schematic diagram showing the sheet post-processing apparatus. The sheet post-processing apparatus 100 processes the sheet ejected from the image forming apparatus 1 according to the instruction of input from the operation panel 5, or the instructions from a PC.

The sheet post-processing apparatus 100 is provided with an entrance roller 102, a branching member 104, a sheet ejecting roller 106, an exit roller 108, a waiting tray (first supporting member) 110, a waiting roller (first ejecting member) 112, a processing tray (second supporting member) 114, an alignment member 116, a stapler 118, a sheet bundle discharging member (second ejecting member) 120, a mounted tray 107 located on the upper portion of the apparatus main body, a movable tray (loading member) 140 located on the side of the apparatus main body, and a shutter (screen) 160.

The entrance roller 102 receives the sheet with images thereon formed in the image forming apparatus 1, and conveys the sheet to the branching member 104. The branching member 104 guides the sheet to the sheet ejecting roller 106 or the exit roller 108.

When the branching member 104 guides the sheet to the sheet ejecting roller 106, the sheet ejecting roller 106 ejects the sheet to the fixed tray 107. On the other hand, when the branching member 104 guides the sheet to the exit roller 108, the exit roller 108 conveys the sheet to the waiting tray 110.

The waiting tray 110 temporarily holds a plurality of conveyed sheets. Further, the waiting tray 110 drops the supported sheets to the processing tray 114, when the waiting tray 110 has received a prescribed number of sheets.

The processing tray 114 receives the sheet dropped by the waiting tray 110. The processing tray 114 keeps supporting of the loaded sheets, during the bundle of sheets are aligned and stapled. The alignment member 116 aligns the bundle of sheets on the processing tray 114 aligning across the conveying direction. The stapler 118 staples the ends of the aligned bundle of sheets. The sheet bundle discharging member 120 ejects the stapled bundle of sheets to the movable tray 140. After the alignment member 116 had aligned the bundle of sheets, by not stapling the bundle of sheets with the stapler 118, the sheet bundle discharging member 120 ejects the bundle of sheets to the movable tray 140.

The waiting tray 110 may directly convey the sheets supported thereon and eject the sheets in the direction towards the movable tray 140, by not stopping the sheets onto the processing tray 114. In this case, the waiting tray 110 and the waiting roller 112 ejects the sheets one by one to the movable tray 140 by not staying the sheets on the waiting tray 110.

The movable tray 140 moves up and down along with the side of the apparatus main body. The detecting member 132 detects the uppermost surface of the bundle of sheets loaded on the upper surface of the movable tray 140, or on the movable tray 140. The detecting member 132 is mounted to the shutter 160. The shutter 160 will be mentioned later. The detecting member 132 detects the position of the movable tray 140. The movable tray 140 moves up and down in response to the ejection of the sheets from the waiting tray 110, the ejection of the sheets from the processing tray 114 or the amount of sheets loaded on the movable tray 140. In the position where the detecting member 132 detects the uppermost surface of the bundle of the sheets loaded on the upper surface of the movable tray 140, or the movable tray 140, the movable tray 140 receives the ejected sheets.

The movable tray 140 moves downward, for example, when one or plural sheets are ejected. The movable tray 140 moves upward, when the detecting member 132 becomes not detecting the uppermost surface of the bundle of sheets loaded on the movable tray 140. The movable tray 140 moves to the position where the detecting member 132 detects the uppermost surface of the bundle of sheets loaded on the movable tray 140, and receives the ejected sheets The movable tray 140 has a loading surface for loading thereon the sheets ejected by the roller 112 or the sheet bundle discharging member 120. The movable tray 140 is mounted to the main part of the sheet post-processing apparatus 100 in an inclination state so that the ends of sheets on the upstream side of the conveying directions of the sheet loaded on the loading surface (the side of the waiting roller 112 or the side of the bundle of sheets ejecting member) becomes lower than the ends of sheets on the downstream side (reverse side). Therefore, the sheets ejected to the movable tray 140 glide down by the inclination of the loading side of the movable tray 140 to the side of the shutter 160 provided in the sheet post-processing apparatus 100.

Figure 3A:
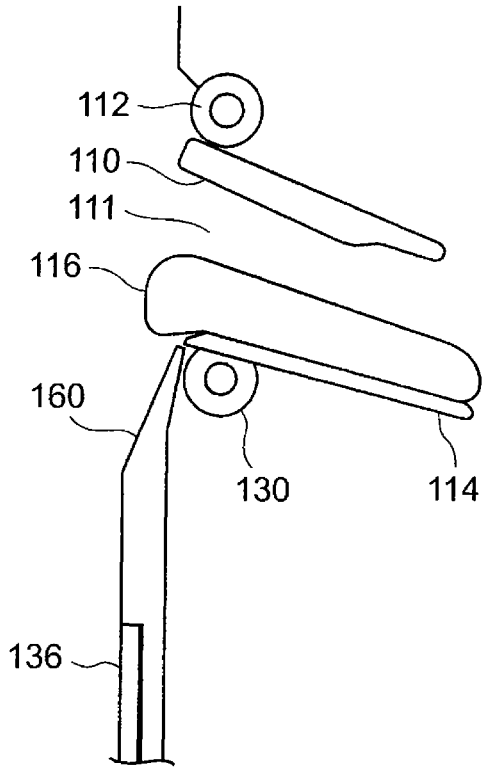
FIGS. 3A and 3B are schematic diagrams showing a shutter associative structure, wherein FIG. 3A indicates an open state of a shutter while FIG. 3B indicates a closed state of the shutter.
Figure 3B:
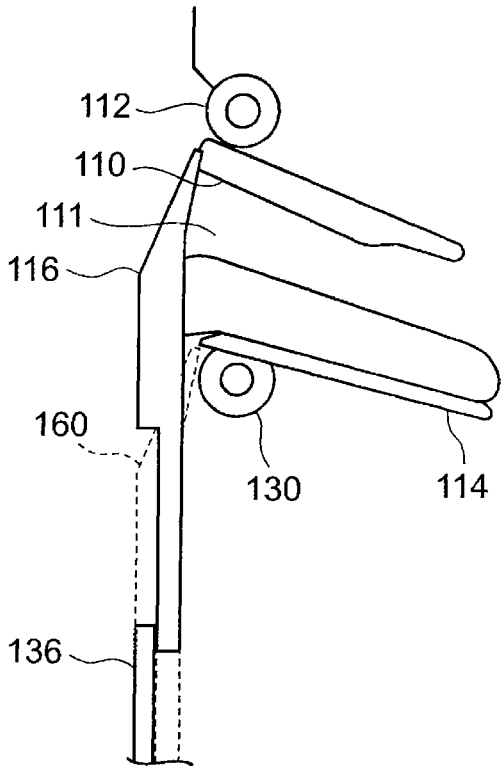

FIGS. 3A and 3B are schematic diagrams for explaining operation of the shutter 160. The shutter 160 moves up and down. When the sheet bundle discharging member 120 discharges the sheets to the movable tray 140, the shutter 160 waits at the first position so as not to interfere the ejection of sheets, as shown in FIG. 3A. On the other hand, when the waiting roller 112 ejects the sheets from the waiting tray 110 directly to the movable tray 140, the shutter 160 moves from the first queuing position to the higher second queuing position, as shown in FIG. 4B. That is, the shutter 160 which waits in the second queuing position prevents entering of the sheets ejected from the waiting tray 110 or the sheets to the side of the processing tray 111 through the opening 111 in front of the processing tray 114. Here, the state that the shutter 160 waits at the first queuing position will be referred as "open state", while the state that the shutter 160 waits at the second queuing position will be referred as "closed state".

In this embodiment, the surface of the shutter 160 at the side of the movable tray 140 is formed in stepped shape (see FIG. 3A). The shutter 160 moves up and down along the cover member 136 of the side surface of the sheet post-processing apparatus 100. By the cover member 136 and the step portion of the shutter 160 contacts each other, the shutter 160 is constituted so that the shutter 160 does not fall any more.

Figure 4:
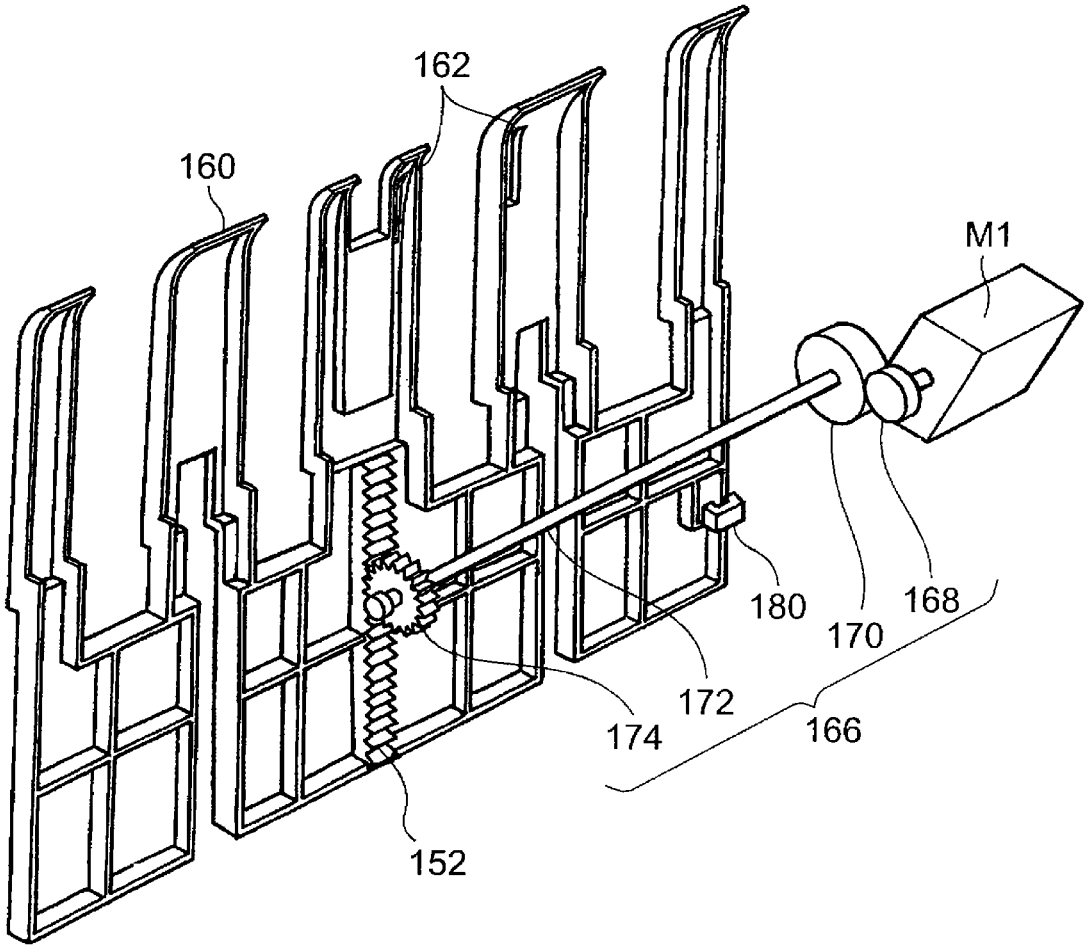
FIG. 4 is a perspective view for explaining the driving structure of the shutter.

FIG. 4 is a perspective view for explaining the driving structure of the shutter 160. The surface of the shutter 160 in the side that the movable tray 140 is arranged will be referred as "front surface", while the other surface will be referred a "back surface". The shutter 160 has a rack 152 on the back surface. The shutter 160 moves up and down by the driving structure 166. The driving structure 166 has a motor M1, gears 168 and 170, a shaft 172, and a gear 174 that meshes with the rack 152. When the power of the motor M1 is transmitted to the gear 174 through the gears 168, 170 and the shaft 172, the shutter 160 moves up and down. The motor M1 may be, for example a stepping motor.

A detecting member 180 detects the elevating position of the shutter 160. The detecting member 180 may be, for example, a sensor, an actuator, etc. In the embodiment, the detecting member 180 detects the closed state of the shutter 160 (hereinafter, referred as home-position, or HP). The position of the shutter 160 is controlled by counts of pulses given to the motor M1 in reference to the HP. In addition, the detecting member 180 may detect the open state of the shutter 160. A detecting member 132 is arranged in a hole portion 162 of the tip end of the shutter 160.

Figure 5:
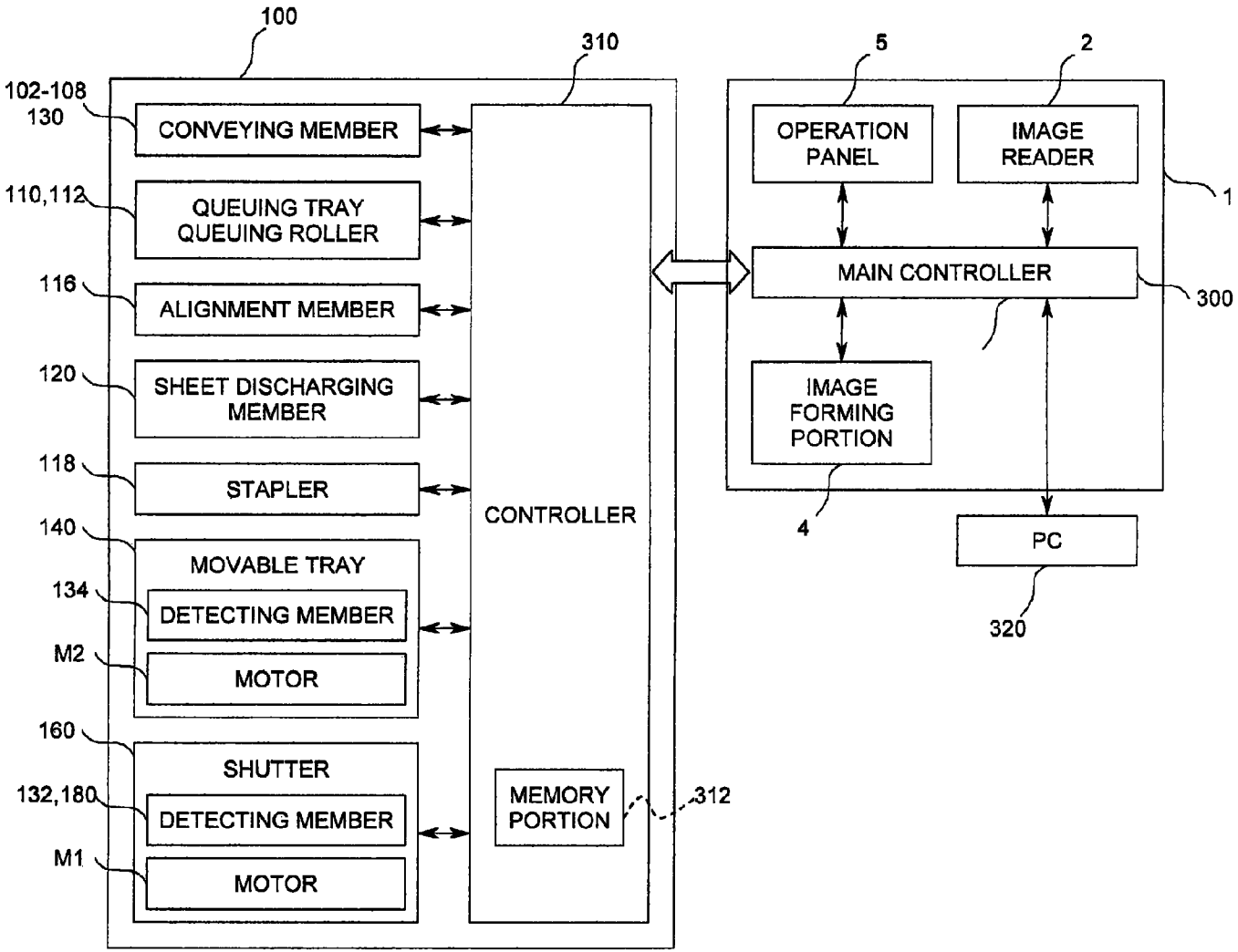
FIG. 5 is a schematic block diagram showing a control system for an image forming apparatus and a sheet post-processing apparatus.

FIG. 5 is a schematic block diagram showing a control system of the image forming apparatus and the sheet post-processing apparatus. The image forming apparatus 1 has a main controller 300. The main controller 300 controls the image reader 2, the image-forming portion 4, the operation panel 5, and the controller 310 of the sheet post-processing apparatus 100. The main controller 300 further executes compensation, a compression, a decompression etc., of image data. The main controller 300 further stores compressed image data, print data in a memory. The main controller 300 further communicates with a PC (personal computer) 320 in external of the image forming apparatus 1.

The controller 310 of the sheet post-processing apparatus 100 has a memory portion 312. The memory portion 312 is a ROM (Read Only Memory) for storing control programs, or a RAM (Random Access Memory) of a working storage for calculation accompanying the control. Based on the instructions from the main controller 300, the controller 310 controls the operations of conveying members, such as the entrance roller 102, the branching member 104, the sheet ejecting roller 106, the outlet rollers 108, and the conveying roller 130, and the waiting tray 110, the waiting roller 112, the alignment member 116, the stapler 118, the sheet bundle discharging member 120, the movable tray 140, and the shutter 160. The controller 310 controls each detecting member.

Figure 6:
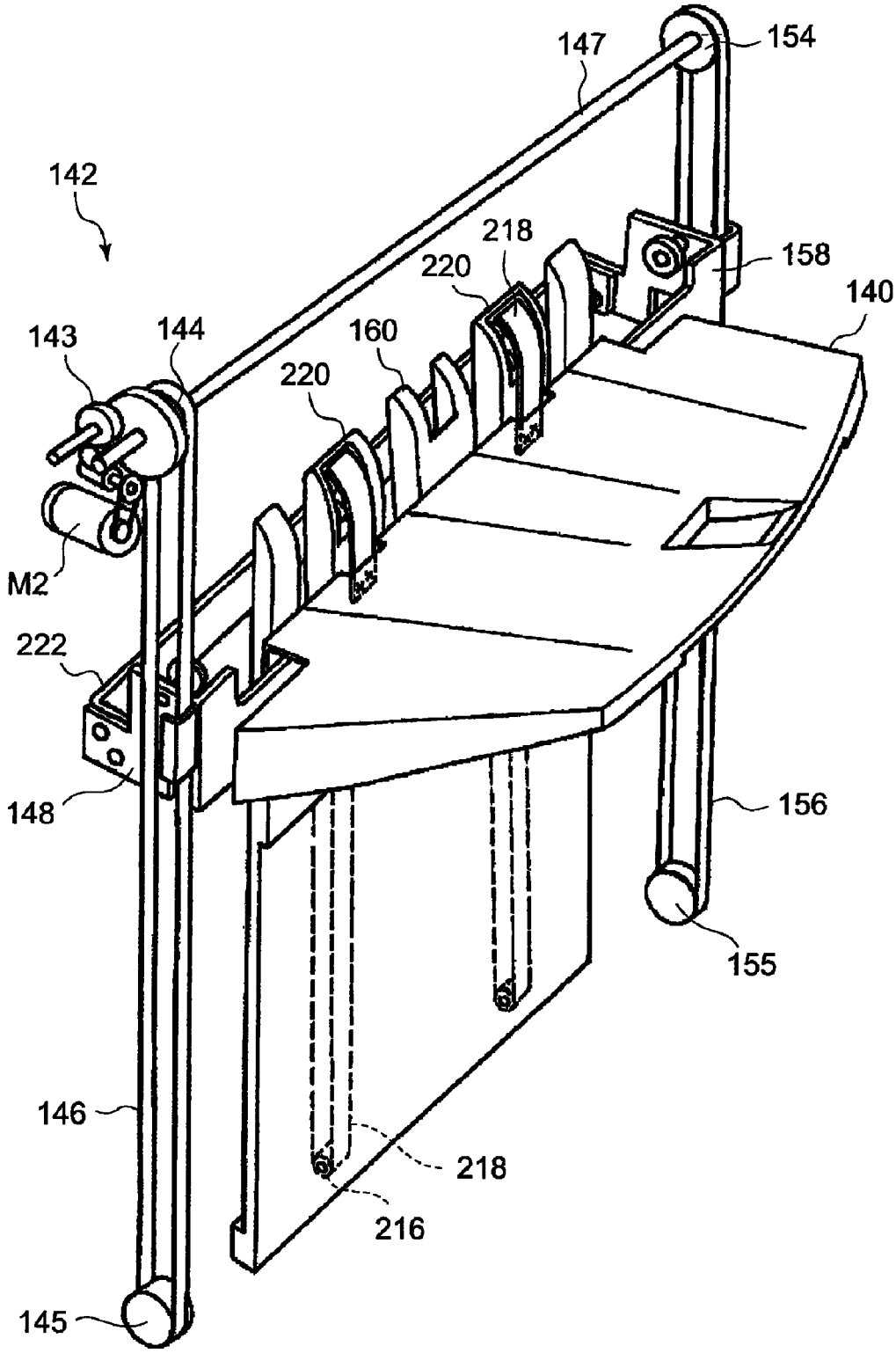
FIG. 6 is a schematic perspective view for explaining another embodiment of a sheet-end supporting member.
Figure 7:
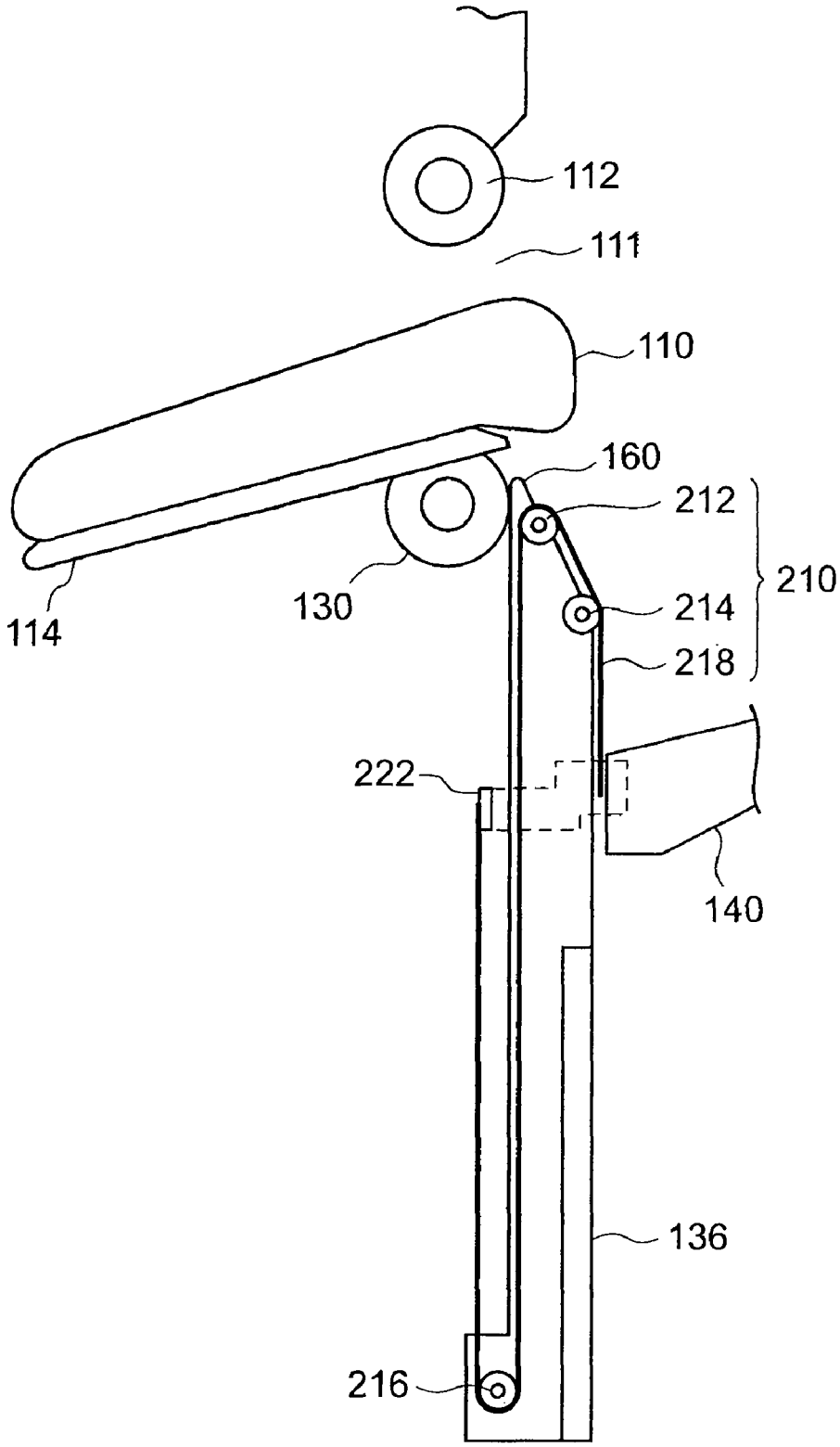
FIG. 7 is a schematic sectional view for explaining still another embodiment of the sheet-end supporting member.

FIG. 6 is a schematic perspective view for explaining another embodiment of a sheet-end supporting member. FIG. 7 is a schematic sectional view for explaining still another embodiment of the sheet-end supporting member. Here, the detecting member 134 is omitted from FIG. 6.

A bridging member 222 is mounted to mounting members 148 and 158 of the movable tray 140. That is, when the motor M2 actuates, the bridging member 222 moves up and down together the movable tray 140.

The sheet-end supporting member 210 has a roller 216 which is a first rotating member, another roller 214 which is a third rotating member, and still another roller 216 which is a second rotating member, and a belt 218 as a movable member. The first, second and third rotating members may be pulleys not but rollers. In addition, the movable member may be a chain, a string, etc., not but limited to the belt. The rollers 212 and 214 are mounted to the upper portion of the shutter 160. On the other hand, the roller 216 is mounted to the lower part of the shutter 160. According to this embodiment, the rollers 212 and 214 are mounted to the hole portion 220 of the upper portion of the shutter 160. In place of the hole portion 220, a cutout may be formed in the upper portion of the shutter 160. The rollers 212, 214 and 216 suspend the belt 218. One end of the belt 218 is fixed to the movable tray 140. The other end of the belt 218 is mounted to the bridging member 222.

The belt 218 stretched even from the roller 212 to the movable tray 140 serves as a position outside the surface outside the surface of the shutter 160, or the cover member 136. Therefore, the posterior end of the sheet loaded on the movable tray 140 contacts to the belt 218. Along the surface of the shutter 216, the belt 218 inclines and is suspended between the roller 212 and 214 in inclination state.

Figure 8C:
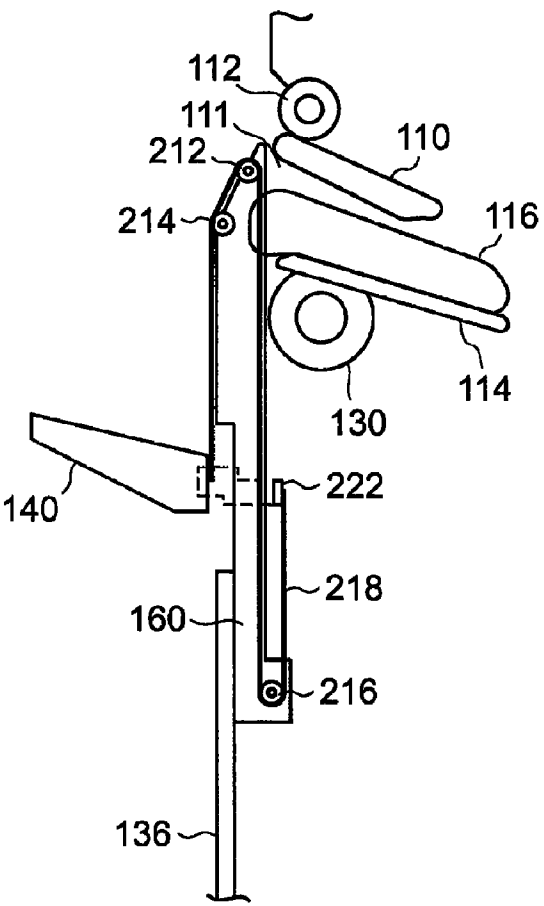
FIGS. 8A to 8C are schematic diagrams for explaining still another embodiment of the sheet-end supporting member.

Now, the operation of the sheet-end supporting member 210 will be explained in reference to FIGS. 8A-8C. When the sheet is ejected through the processing tray 114, the shutter 160 waits in the first waiting position not preventing the ejection of the sheet, as shown in FIG. 8A (open state). The sheet ejected to the movable tray 140 moves to the shutter 160 side by the inclination of the loading surface of the movable tray 140. Then, the posterior end of the sheet contacts to the belt 218 of the sheet-end supporting member 210.

Figure 8B:
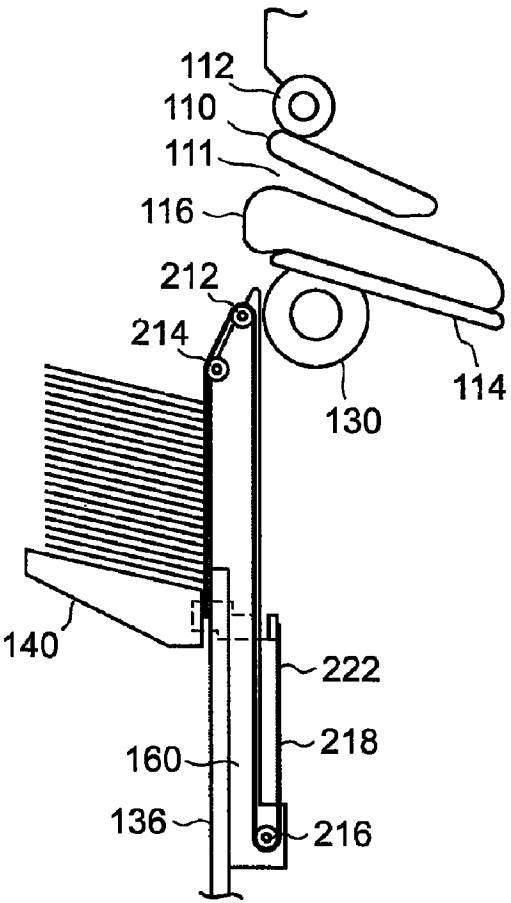
Figure 8A:
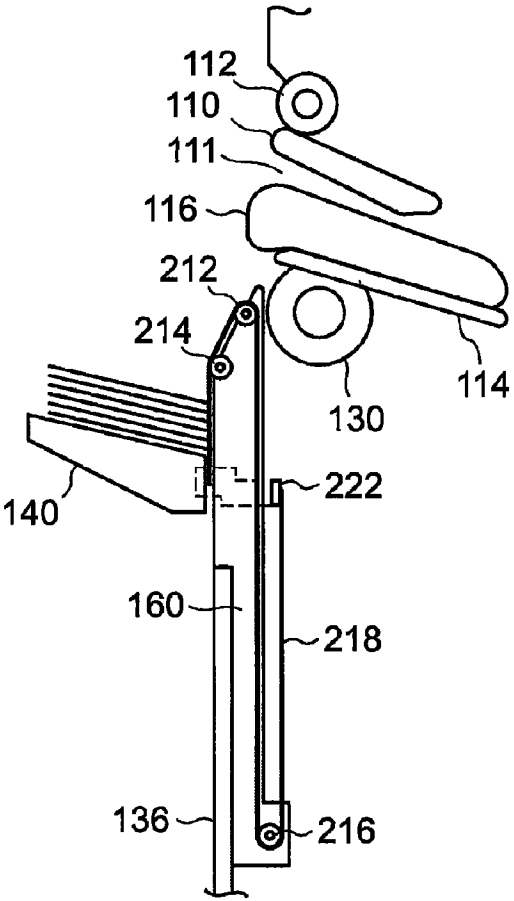

As shown in FIG. 8B, the movable tray 140 comes down in following that the amount of the loaded sheets increases. The sheet on the movable tray 140 is supported its ends by the belt 218 of the sheet-end supporting member 210. In this embodiment, as mentioned above, both ends of the belt 218 are mounted to the movable tray 140 and the bridging member 222, respectively, and the belt 218 is suspended by the rollers 212, 214, and 216. Therefore, the belt 218 runs following the movement of the movable tray 140. That is, when the movable tray 140 descends, the belt 218 is pulled out from the hole portion 220 of the shutter 160, and the length of the belt 218 pulled out from the roller 212 to the movable tray 140 and stretched from the roller 212 to the movable tray 140 becomes elongated. On the other hand, when the movable tray 140 ascends, the belt 218 is pulled in the hole portion 220 of the shutter 160, and the length of the belt 218 set up from the roller 212 to the movable tray 140 becomes short. As just described, according to this embodiment, since the sheet-end supporting member 210 is interlocked with the movement of the movable tray 140, any special kind of driving structure is not needed to use.

In a case that the waiting roller 112 ejects the sheet from the waiting tray 110 directly to the movable tray 140, the shutter 160 moves from the first waiting position to the second upper waiting position, as shown in FIG. 8C. The shutter 160 waiting in the second waiting position prevents the sheet ejected from the waiting tray 110 or the sheet on the movable tray 140 entering to the processing tray 114 side. According to an embodiment, as mentioned above, the belt 218 is mounted at its both ends to the movable tray 140 and the bridging member 222, and suspended by the rollers 212, 214 and 216. Therefore, the belt 218 moves together with the shutter 160. When the shutter 160 ascends after the movable tray 140 has stopped, the length of the belt 218 between the roller 216 and the bridging member 222 becomes short, and the length of the belt 218 stretched from the roller 212 to the movable tray 140 becomes elongated. That is, the belt 218 is pulled out from the hole portion 220 of the shutter 160. On the other hand, when the shutter 160 descends after the movable tray 140 has stopped, the length of the belt 218 between the roller 216 and the bridging member 222 becomes elongated, and the length of the belt 218 stretched from the roller 212 to the movable tray 140 becomes short. That is, the belt 218 is pulled into the hole portion 220 of the shutter 160. Thus, according to this embodiment, since the sheet-end supporting member 210 (or roller 216) moves together with the shutter 160, the sheet-end supporting member 210 (or roller 216) is able to appropriately supports the ends of the sheets.

Figure 9B:
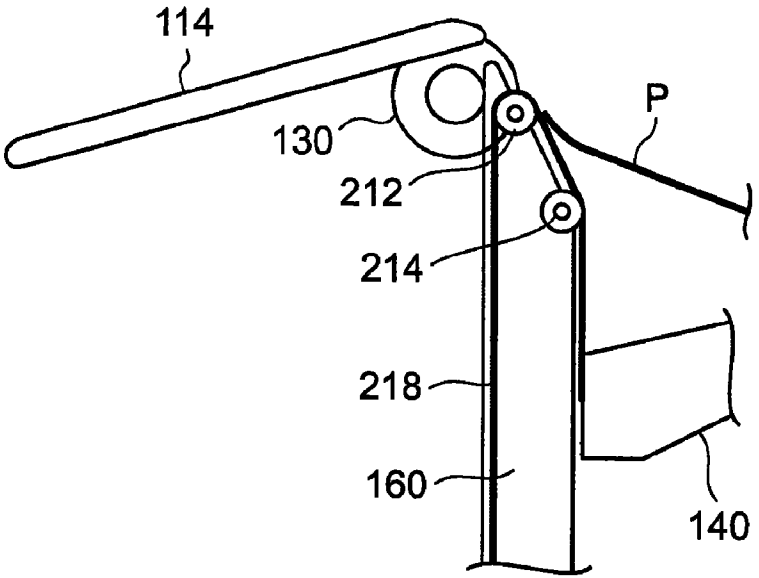
FIGS. 9A and 9B are schematic diagrams for explaining still another embodiment of the sheet-end supporting member.
Figure 9A:
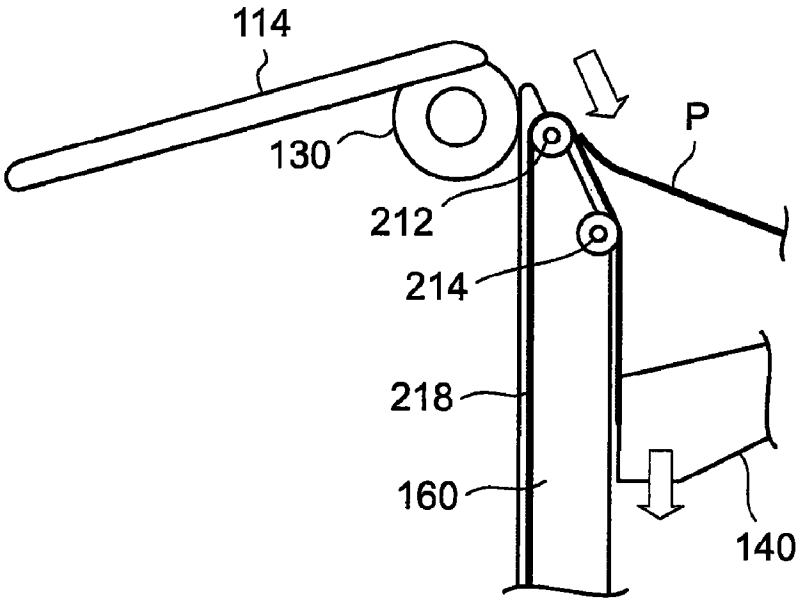

The belt 218 is suspended between rollers 212 and 214 in inclining along the surface no the shutter 160. Therefore, even if the posterior end of the sheet P has stopped at the upper portion of the shutter 160, as shown in FIG. 9A, the belt 218 runs following the above-mentioned sheet loading operation of the movable tray 140, and drops the sheet P on the movable tray 140. That is, the belt 218 encourages loading of the sheet P to the movable tray 140. Therefore, the sheet P is able to stop in the slope of the shutter 160 and it is able to prevent barring loading of a following sheet. By the way, the roller 212 of the sheet-end supporting member 210 is preferred to be arranged so that it may overlap with the conveying roller 130, as shown in FIG. 9B. The posterior end of the sheet ejected from the gap between the conveying roller 130 and the roller 212 is able to be prevented from remaining in the gap.

In this embodiment, although one end of the belt 218 of the sheet-end supporting member 210 is mounted to the movable tray 140 and the other end of the belt 218 is mounted to the bridging member 222 of the movable tray 140. However, it is not limited to such a constitution. For example, one end of the belt 218 may be mounted to the movable tray 140, and weight may be mounted to the other end. Or elastic members, such as a spring, may be mounted to the other end, and the belt 218 may be mounted to the main part of the sheet post-processing apparatus 100.

Figure 10:
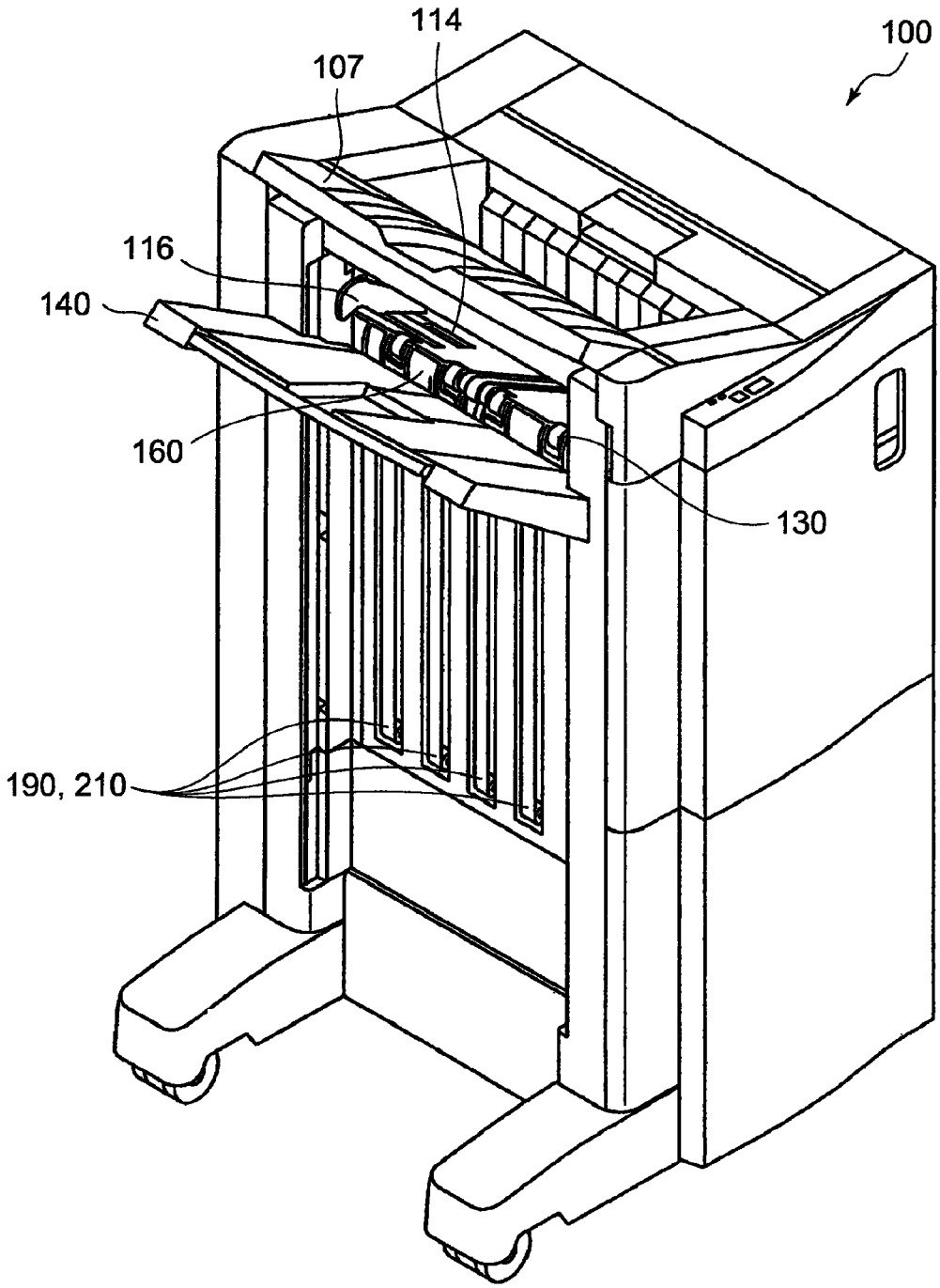
FIG. 10 is a schematic sectional view showing a sheet post-processing apparatus for explaining still another embodiment of the sheet-end supporting member.

Although the above-mentioned embodiment explained as that the sheet-end supporting member 210 uses two belts, it is not limited to such a constitution. For example, as shown in FIG. 10, four belts may be used as the sheet-end supporting member. For example, in a case of supporting the posterior ends of small size sheets like B5 size sheet, two belts may be used inside or in either side. While in a case of supporting the posterior ends of large size sheets like A3 size sheet, four belts may be used.

Further, the surface in contact with the sheet posterior end of the belt 218 is preferable to be of low frictional properties. Or, the surface may comprise shock absorbing material, such as rubber and sponge, and construction material of a low friction coefficient mounted to the surface of this shock absorbing material.

A Second Embodiment

Figure 11:
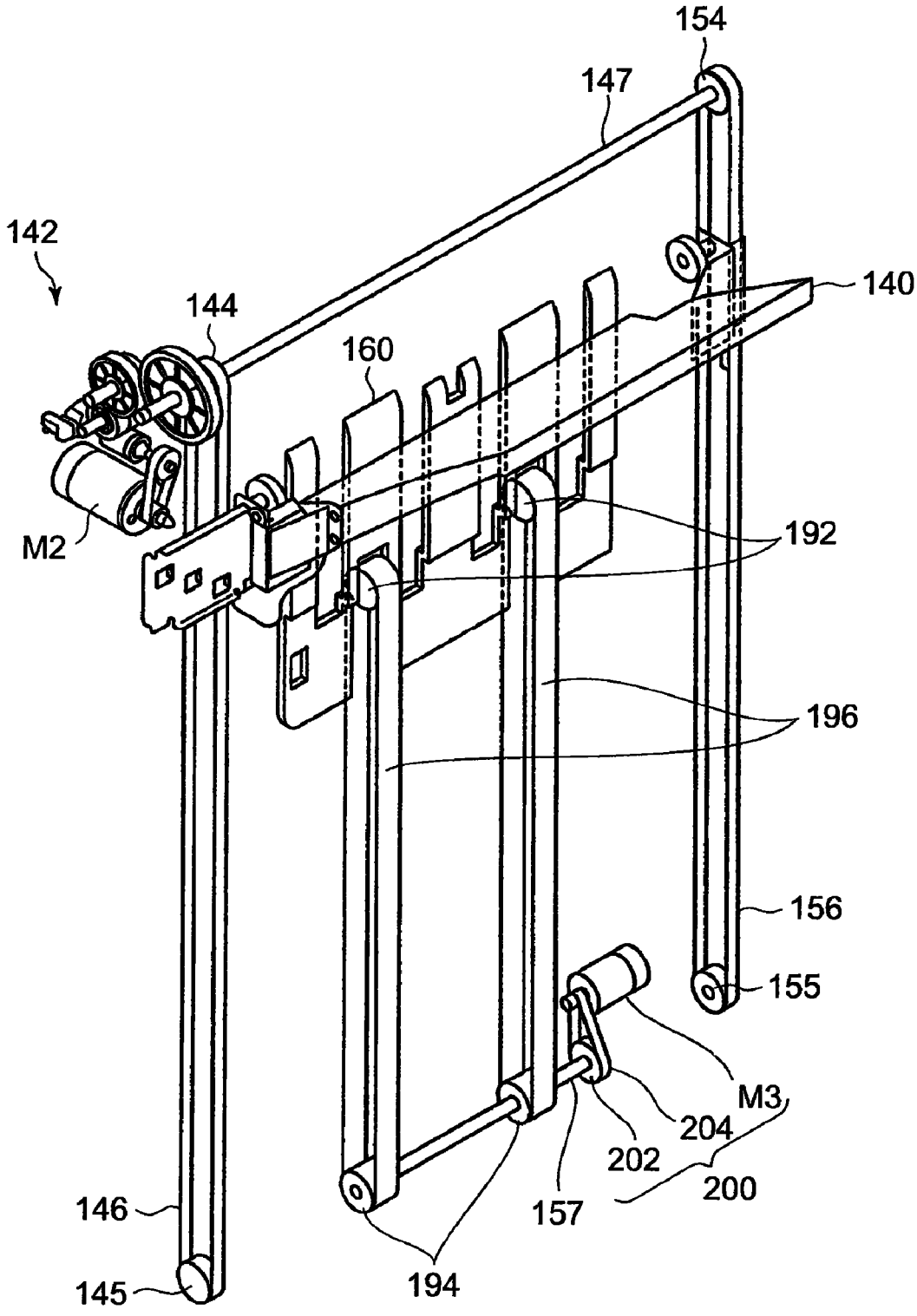
FIG. 11 is a schematic diagrams for explaining driving structure for a second embodiment of the sheet-end supporting apparatus.

As shown in FIG. 11; a driving structure 200 with another driving structure 142 of a movable tray 140 drives a sheet-end supporting member 190. The driving structure 200 is provided with a pulley 202, a belt 204, and a motor M3 which is a driving source. The motor M3 may be, for example, a stepping motor. The pulley 202 is mounted to the end of the shaft 157. When the power of the motor M3 gets across to the shaft 157 through the belt 204 and the pulley 202, a belt 196 as a movable member for the sheet-end supporting member 190 runs. By the way, a controller 310 controls the running direction and the running speed of the belt 196 by the number of pulses given to the motor M3. The belt 196 runs in synchronizing with a movement of the movable tray 140. The belt 196 starts running in synchronizing with the start of movement of the movable tray 140, and quits running in synchronizing with the stop movement of the movable tray 140. The belt 196 runs by a distance the same as the moving distance of the movable tray 140 in the moving direction of the movable tray 140.

Modification of Second Embodiment

The noise caused due to the vibration of the posterior end of the sheet becomes remarkable when a large amounts of plain paper sheets, e.g., 1,500 number of plain sheets are loaded to the movable tray 140. Therefore, when an amount of sheets loaded on the movable tray 140 is small, the sheet-end supporting member 190 may not operate. Now, a case that in this embodiment a large amounts of sheets are loaded on the movable tray 140, and that the ejection control drives the sheet-end supporting member 190 in interlocking with movement of the movable tray 140 will be explained.

Figure 13:
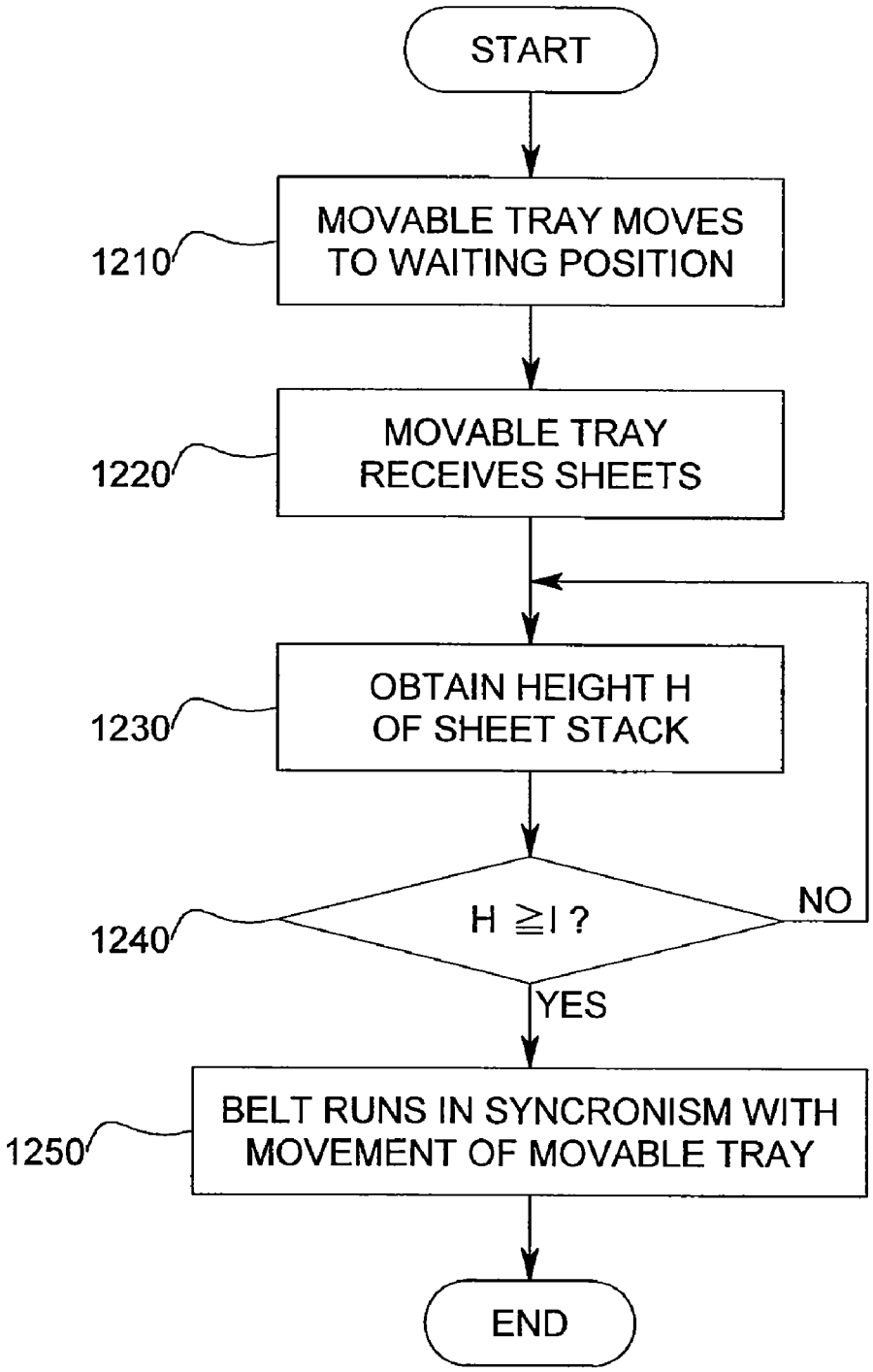
FIG. 13 is a flow chart for explaining one example of a sheet ejection control for the second embodiment of the sheet-end supporting member.

FIG. 13 is a flow chart for explaining one example of a sheet ejection control. When an image-forming processing starts with an instruction from the operation panel 5 or the PC 320, at 1210 the movable tray 140 moves to a waiting position where the detecting member 132 detects the upper surface of the movable tray 140. The image forming apparatus 1 forms an image on a sheet. At 1220, when a waiting roller 112 or the sheet bundle discharging member 120 ejects sheets, the movable tray 140 receives the ejected sheet. The end supporting member 190 waits not driving in synchronizing with movement of the movable tray 140.

At 1230, the controller 310 obtains height H of the sheet loaded into the movable tray 140. In this embodiment, the movable tray 140 receives a following sheet in the position where the detecting member 132 detects the upper surface of the movable tray 140. Therefore, the controller 310 obtains the height H of the sheet based on the position of the movable tray 140 detected by the detecting member 134, or counts of pulses driving the motor M2. By the way, a sensor for detecting the height of the sheet may be provided.

At 1240, the controller 310 judges whether the height H is larger than a reference value I. The reference value I is a value (threshold) set up as predetermined height. Initialized value should just find height in case of generating noise caused by vibration of the posterior end of the sheet becomes remarkable from a theoretical formula or an experimental result. Further, the initialized value may be set up according to the kind of sheet. The initialized value is able to be defined by manufacturers. Or the initialized value is able to be defined by that users or specified administrator set up through the operation panel 5 or the PC 320. Here, a value smaller then the reference value I will be referred as first value, and a value larger then the reference value I will be referred as second value.

When the height H is smaller than the reference value I (1240: No), the end supporting member 190 waits without driving in synchronizing with the movement of the movable tray 140. When height H is equal to the reference value I or the second value larger than the reference value I (1240: Yes), at 1250 the end supporting member 190 runs in synchronizing with the movement of the movable tray 140.

This embodiment produces a similar effect with that of the first embodiment, and capable of reducing a load to the driving structure 142 of the movable tray 140. Further, a power consumption is able to be suppressed by changing the supporting member 190 from waiting state to the operating state for moving the movable tray 140 according to the height of the sheets loaded on the movable tray 140. Here, in this embodiment, although the value H and the reference value I are values relating to the movable tray 140, they may be other value relating to the number of sheets sent to the movable tray 140. In this case, the main controller 300 or the controller 310 judges whether the number-of-sheets value H' is larger than a reference value I'. The reference value I' is a value (threshold value) set up as a predetermined number of sheets. Based on the instructions received from the operation panel 5 or the PC 320, the main controller 300 may set up the number-of-sheets value H' of the sheet sent to the movable tray 140. Or the number of sheets may be counted by the main controller 300 or the controller 310, by providing a sheet conveying path for detecting sheets formed image thereon.

Figure 12B:
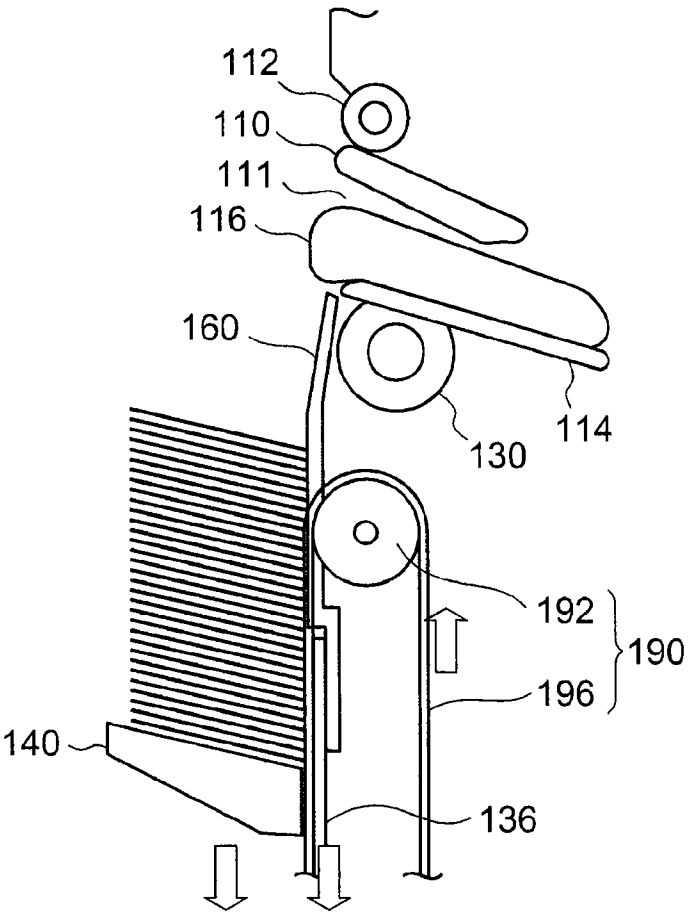
FIGS. 12A and 12B are schematic diagrams for explaining an sheet ejection movement of the second embodiment of the sheet-end supporting member.
Figure 12A:
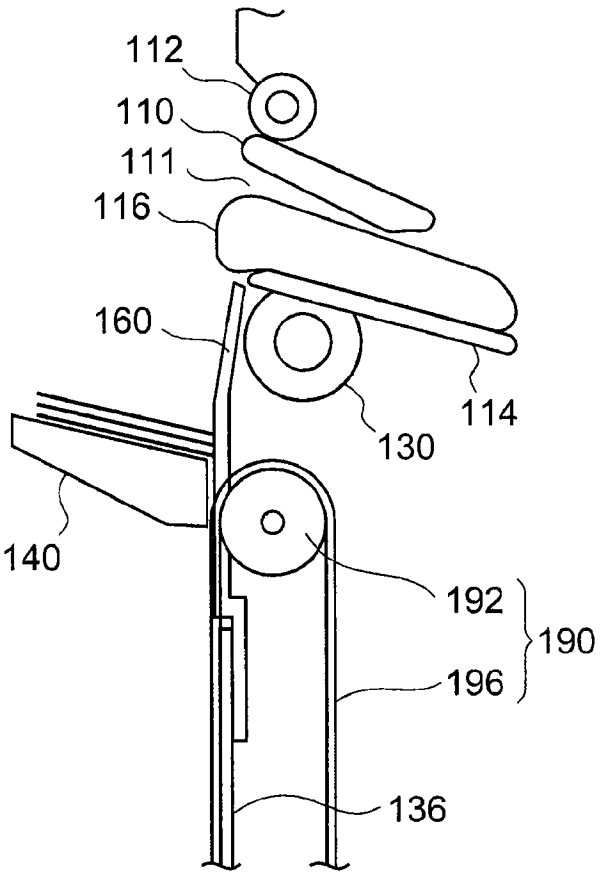

Referring now to FIGS. 12A and 12B, an operation at the time of ejection will be explained. When sheets are ejected through the processing tray 114, the shutter 160 waits in the first waiting position not preventing ejection of the sheet, as shown in FIG. 12A (open state). The sheet ejected to the movable tray 140 moves to the shutter 160 side by the inclination of the loading surface of the movable tray 140. Then the posterior end of the sheet contacts to the shutter 160.

The movable tray 140 descends when for example one sheet or plural sheets are ejected to the movable tray 140.

When the detecting member 132 quits detecting of the uppermost surface of the sheet loaded on the movable tray 140, the movable tray 140 ascends. Then the movable tray 140 moves to the position where the detecting member 132 detects the uppermost surface of the sheet loaded on the movable tray 140, and the sheet ejected is loaded. According to this embodiment, the movable tray 140 gradually descends in response to a sheet ejection from the waiting tray 110, a sheet ejection from the processing tray 114 or an amount of loaded sheets.

When the sheet is ejected so much and the movable tray 140 falls rather than a predetermined position as shown in FIG. 12B, the belt 196 of the sheet-end supporting member 190 supports the end of the sheet one by one from the sheet of the bottom on the movable tray 140. According to this embodiment, as mentioned above, the surface of the belt 196 positions in the movable tray 140 side rather than the surface outside the cover member 136. Therefore, the contact of the sheet-ends to the cover member 136 is prevented or reduced as much as possible.

The belt 196 runs by a distance the same as the moving distance of the movable tray 140 in the moving direction of the movable tray 140 in interlocking with movement of the movable tray 140. That is, the contact position of the posterior end of the sheet and the belt 196 does not change. The belt 196 quits running in interlocking with the quitting movement of the movable tray 140. The movable tray 140 moves without making the sheet contact with the belt 196 for loading the sheets.

The sheet post-processing apparatus 100 of this embodiment is provided with the sheet-end supporting member 190 having the belt 196 for running a distance the same the moving distance of the movable tray 140 moving in interlocking with the movable tray 140. Therefore, the movable tray 140 is able to move up and down, without making the posterior end of the sheet to contact with the cover member 136 and the sheet-end supporting member 190. Thereby, noises due to vibrations of the posterior ends of the sheets loaded on the movable tray 140 in large amounts is able to be suppressed.

In this embodiment, the sheet-end supporting member 190 is arranged so that the shutter 160 and the belt 190 are partially overlap with each other in the moving direction of the movable tray 140. However, the sheet-end supporting member 190 may be arranged in further below position so that the shutter 160 and the belt 196 do not overlap with each other. The noise caused due to the vibration of the posterior end of the sheet becomes remarkable when a large amount of plain paper sheets, e.g., 1,500 number of plain sheets are loaded to the movable tray 140. Then, the sheet-end supporting member 190 may be arranged in a position where the noise caused by the vibration becomes remarkable.

Figure 14:
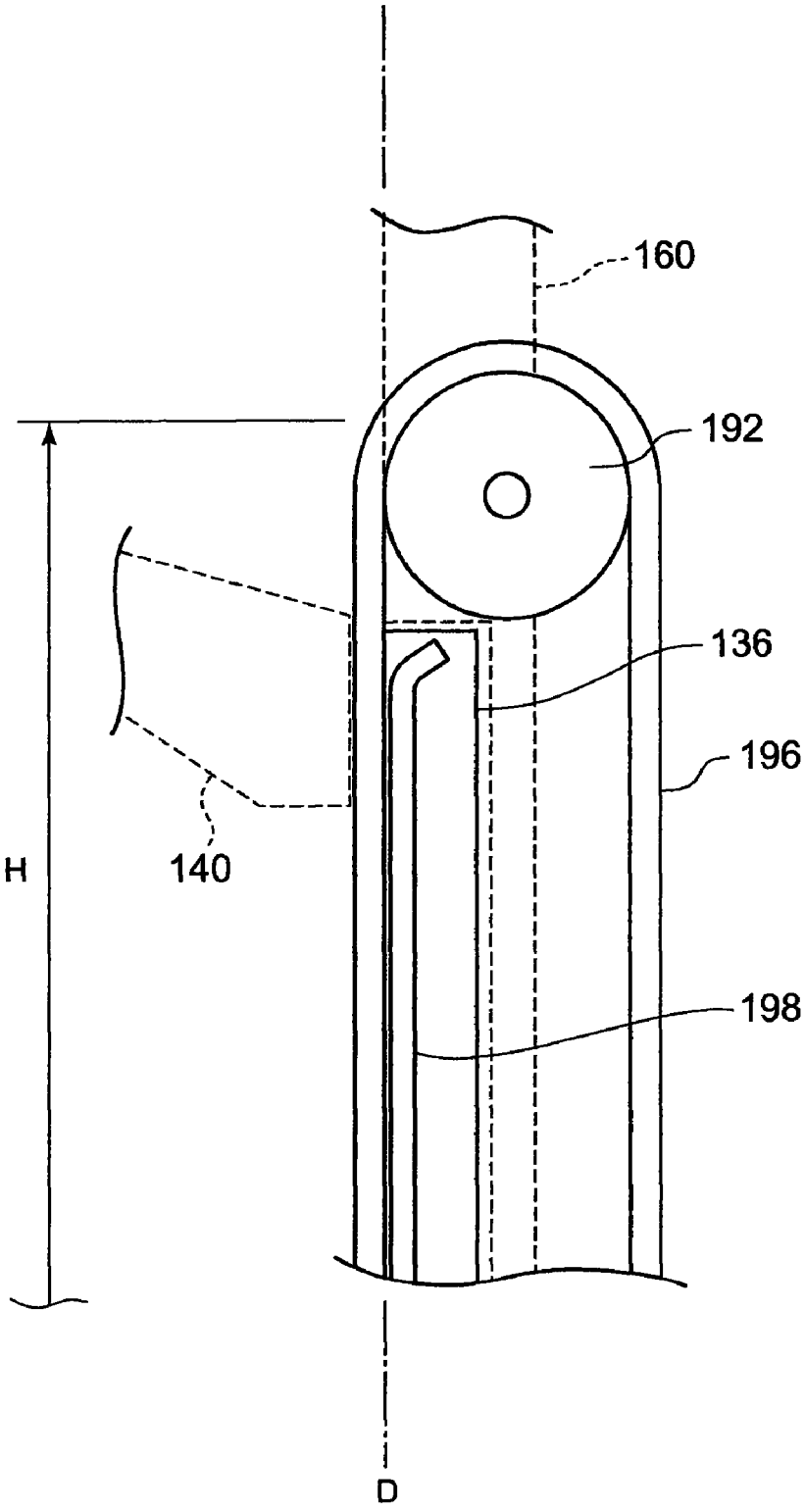
FIG. 14 is a schematic diagram for explaining the sheet-end supporting member.

As shown in FIG. 14, a predetermined portion, for example, the surface of the belt 196 in the side of the moving tray 140 in facing with the belt 196 via the pulleys 192 and 194 becomes a position in the side of the movable tray 140 near than the outer surface of the cover member 136 of the post-sheet processing apparatus 100. Therefore, the posterior end of the sheet loaded on the movable tray 140 contacts to the belt 196 located in this range H. Further, an auxiliary member 198 is arranged on the back side of the belt 196. The auxiliary member 198 regulates the movement of the belt 196 in the thickness direction of the belt 196 which intersects the running direction of the belt 196 in the range H. For example, when a large amounts of the sheets are loaded onto the movable tray 140, a power is perpendicularly applied to the surface of the belt 196 contacting with the sheet by the sheets own weight. The auxiliary member 198 restricts the movement of the belt 196 in the first direction due to the sheet loaded on the movable tray 140. That is, the auxiliary member 198 holds the state that the surface of the belt 196 for loading the sheet becomes to have a position in the side of the movable tray 140 then the outer surface no the cover member 136. By the way, in FIG. 14, the surface of the cover member 136 locates on a chain line D.

The present invention is not restricted to the embodiment described above but, it can be modified variously without departing from the scope thereof.

What is claimed is:

1. A sheet loading apparatus comprising:

an ejecting member to eject a sheet;

a loading member to load the sheet ejected by the ejecting member;

a movable member capable of moving in a state keeping contact with ejecting member side ends of the sheets loaded on the loading member, the movable member moving a distance equal to a moving distance of the loading member in the moving direction of the loading member;

a screen which is located between the loading member and the ejecting member and moves up and down, while waits at a position capable of avoiding interruption to the ejection of the sheet; and a first rotating member mounted to the screen in a location above the loading member and suspending the movable member.

2. The apparatus of claim 1, wherein the loading surface of the loading member loads the sheets so as that the position of the ejecting member side ends of the sheets is lower than the other ends of the sheets.

3. The apparatus of claim 1 further comprising:

an end fastening member which is located in the opposite side of the loading member against the screen, and the end of the movable member is mounted to the screen and moves up and down with the loading member; and a second rotating member laid below the loading member, wherein the movable member is suspended to the first and second rotating members so as that the first and second rotating members rotate in opposite direction with each other and the other end of the movable member is mounted to the loading member.

4. The apparatus of claim 3 further comprising:

a third rotating member mounted to the screen in a position above the loading member and below the first rotating member and suspending the movable member, wherein the first rotating member is mounted to the fore-end of the screen, and the movable member inclines and is suspended between the first and third rotating members in inclination state.

5. The apparatus of claim 1 further comprising:

a detecting member to detect the height of the sheets loaded on the loading member;

a driving unit to drive the movable member; and a controller to control the driving unit to actuate when the height of the sheets detected by the detecting member is larger than a prescribed threshold height.

6. The apparatus of claim 1 further comprising:

a detecting member to detect the number of sheets loaded on the loading member;

a driving unit to drive the movable member; and a controller to control the driving unit to actuate when the number of sheets detected by the detecting member is larger than a prescribed threshold number of sheets.

7. A sheet post-processing apparatus comprising:

a waiting tray to queue sheets for a sheet post-processing;

a processing tray which is located underneath the waiting tray and receives the sheets supplied from the waiting tray;

a stapler to staple the ends of a plurality of sheets supplied on the processing tray;

a loading member to load sheets;

an ejecting member to eject the sheets from at least one of the waiting tray and the processing tray to the loading member;

a movable member capable of moving in a state keeping contact with ejecting member side ends of the sheets loaded on the loading member, the movable member moving a distance equal to a moving distance of the loading member in the moving direction of the loading member;

a screen which is located between the loading member and the ejecting member and moves up and down, while waits at a position capable of avoiding interruption to the ejection of the sheet; and a first rotating member mounted to the screen in a location above the loading member and suspending the movable member.

8. The apparatus of claim 7, wherein the screen shuts an opening formed in front of the processing tray when a post-processing of the sheets is not chosen so that the sheets is ejected from the waiting tray to the loading member.

9. The apparatus of claim 7, wherein the loading surface of the loading member loads the sheets so as that the position of the ejecting member side ends of the sheets is lower than the other ends of the sheets.

10. The apparatus of claim 7 further comprising:

an end fastening member which is located in the opposite side of the loading member against the screen, and the end of the movable member is mounted to the screen and moves up and down with the loading member; and a second rotating member laid below the loading member, wherein the movable member is suspended to the first and second rotating members so as that the first and second rotating members rotate in opposite direction with each other and the other end of the movable member is mounted to the loading member.

11. The apparatus of claim 10 further comprising:

a third rotating member mounted to the screen in a position above the loading member and below the first rotating member and suspending the movable member, wherein the first rotating member is mounted to the fore-end of the screen, and the movable member inclines and is suspended between the first and third rotating members in inclination state.

12. The apparatus of claim 7 further comprising:

a detecting member to detect the height of the sheets loaded on the loading member;

a driving unit to drive the movable member; and a controller to control the driving unit to actuate when the height of the sheets detected by the detecting member is larger than a prescribed threshold height.

13. The apparatus of claim 7 further comprising:

a detecting member to detect the number of sheets loaded on the loading member;

a driving unit to drive the movable member; and a controller to control the driving unit to actuate when the number of sheets detected by the detecting member is larger than a prescribed threshold number of sheets.

14. An image forming apparatus comprising:

an image forming portion to form images on sheets; and a sheet loading apparatus to load the sheets formed thereon the images and taken out from the image forming portion, wherein the sheet loading apparatus including:

an ejecting member to eject a sheet from the image forming portion;

a loading member to load the sheet ejected by the ejecting member;

a movable member capable of moving in a state keeping contact with ejecting member side ends of the sheets loaded on the loading member, the movable member moving a distance equal to a moving distance of the loading member in the moving direction of the loading member;

a screen which is located between the loading member and the ejecting member and moves up and down, while waits at a position capable of avoiding interruption to the ejection of the sheet; and a first rotating member mounted to the screen in a location above the loading member and suspending the movable member.

15. The apparatus of claim 14, wherein the loading surface of the loading member loads the sheets so as that the position of the ejecting member side ends of the sheets is lower than the other ends of the sheets.

16. The apparatus of claim 14 further comprising:

an end fastening member which is located in the opposite side of the loading member against the screen, and the end of the movable member is mounted to the screen and moves up and down with the loading member; and a second rotating member laid below the loading member, wherein the movable member is suspended to the first and second rotating members so as that the first and second rotating members rotate in opposite direction with each other and the other end of the movable member is mounted to the loading member.

17. The apparatus of claim 16 further comprising:

a third rotating member mounted to the screen in a position above the loading member and below the first rotating member and suspending the movable member, wherein the first rotating member is mounted to the fore-end of the screen, and the movable member inclines and is suspended between the first and third rotating members in inclination state.

18. The apparatus of claim 14 further comprising:

a detecting member to detect the height of the sheets loaded on the loading member;

a driving unit to drive the movable member; and a controller to control the driving unit to actuate when the height of the sheets detected by the detecting member is larger than a prescribed threshold height.

19. The apparatus of claim 14 further comprising:

a detecting member to detect the number of sheets loaded on the loading member;

a driving unit to drive the movable member; and a controller to control the driving unit to actuate when the number of sheets detected by the detecting member is larger than a prescribed threshold number of sheets.

20. The apparatus of claim 14 further comprising:

a waiting tray to queue sheets for a sheet post-processing; and a processing tray which is located underneath the waiting tray and receives the sheets supplied from the waiting tray, wherein the screen shuts an opening formed in front of the processing tray when a post-processing of the sheets is not chosen so that the sheets is ejected from the waiting tray to the loading member.

* * * * *